US005575718A

United States Patent [19]

Simmons

[11] Patent Number: 5,575,718

[45] Date of Patent: Nov. 19, 1996

[54] MANUALLY OPERATED BOWLING APPARATUS

[76] Inventor: Nathaniel Simmons, 10-Douglas Dr., Greenville, S.C. 29605

[21] Appl. No.: 523,124

[22] Filed: Sep. 1, 1995

[51] Int. Cl.[6] ..... A63D 5/08

[52] U.S. Cl. ..... 473/78; 473/116

[58] Field of Search ..... 473/68, 78, 79, 473/80, 81, 82

[56] References Cited

U.S. PATENT DOCUMENTS

| | | | |
|---|---|---|---|
| 92,467 | 7/1869 | Pierce | 473/78 |
| 156,334 | 10/1874 | Conlin | 473/78 |
| 664,887 | 1/1901 | Neumann | 473/78 |
| 1,224,727 | 5/1917 | Feron | 473/78 |
| 3,480,279 | 11/1969 | Ingebo . | |
| 3,738,648 | 6/1973 | Strickland . | |
| 3,809,398 | 5/1974 | Schmid et al. . | |
| 3,966,206 | 6/1976 | Schmid . | |
| 4,376,534 | 3/1983 | Schmid . | |
| 5,167,412 | 12/1992 | Rochefort | 473/78 |

FOREIGN PATENT DOCUMENTS

| | | | |
|---|---|---|---|
| 282079 | 2/1915 | Germany | 473/78 |

*Primary Examiner*—William M. Pierce

[57] ABSTRACT

A manually operated bowling apparatus is provided for use with a bowling lane and a bowling ball and includes a support assembly which includes leg members which straddle an end portion of the bowling lane assembly. The apparatus also includes an overhead support member supported by the leg members. A tether guide plate is supported by the support assembly at a position between the overhead support member and the bowling lane. The tether guide plate includes ten pin-tether guide apertures arrayed in a triangular pin-set arrangement. A pin guide assembly includes a pin-guide plate suspended by a plurality of flexible support cables from a first winch assembly supported by the overhead support member. The pin-guide plate includes ten pin-guide apertures arrayed in a triangular pin-set arrangement. The pin-tether guide apertures and the pin-guide apertures are in registration with each other. A set of ten bowling pin assemblies are connected to a second winch assembly supported by the overhead support member. Each of the bowling pin assemblies includes a bowling pin member and a pin tether connected between the bowling pin member and the second winch assembly. The pin tethers are threaded from the bowling pin members through the pin-guide apertures and through the pin-tether guide apertures before connection to the second winch assembly. The first winch assembly controls raising and lowering of the pin-guide plate. The second winch assembly controls raising and lowering the bowling pin members.

6 Claims, 3 Drawing Sheets

MANUALLY OPERATED BOWLING APPARATUS

BACKGROUND OF THE INVENTION

1. Field of the Invention

The present invention relates generally to bowling devices and, more particularly, to bowling devices that are operated manually.

2. Description of the Prior Art

In its most basic form, the sport of bowling is carried out with bowling balls, a bowling lane, and a set of bowling pins. In its most basic form, when pins that have been knocked down have to be reset, the pins are reset manually. This means that ten pins have to be reset by a person one pin at a time. Manually setting ten pins one at a time is quite time consuming. In this respect, it would be desirable if a bowling apparatus were provided which does not require a person to manually reset knocked down bowling pins one pin at a time.

Over the years, to preclude the necessity of manually resetting bowling pins one pin at a time, automatic pin setting machinery has been developed which reset bowling pins ten at a time. Such automatic pin setting apparatus is heavy, expensive, and complex and requires a fixed structure or building to be housed in. Such automatic pin setting apparatus consumes a lot of energy to operate and requires highly trained personnel to maintain and repair. In this respect, it would be desirable if a bowling apparatus were provided which resets ten bowling pins at a time without using complex automatic pin setting apparatus.

Automatic bowling pin setting devices are of two types: those in which individual bowling pins are not connected to the pin setting apparatus; and those in which individual bowling pins are tethered to the apparatus. As of interest, the following U.S. patents disclose automatic bowling pin resetting apparatus in which individual bowling pins are not connected to the pin setting apparatus: U.S. Pat. Nos. 3,738,648; 3,809,398; and 3,966,206.

Also, as a matter of interest, the following U.S. patents disclose automatic bowling pin resetting apparatus in which individual bowling pins are tethered to the pin setting apparatus: U.S. Pat. 3,480,279 and 4,376,534. More specifically, U.S. Pat. No. 3,480,279 discloses a bowling pin resetting apparatus which includes tethered bowling pins, each of which as a dedicated counter weight and a pulley for supporting the counterweight. This means that there are ten pulleys and ten counterweights. It would be desirable is such complexities could be avoided. In this respect, it would be desirable if a bowling apparatus were provided which does not employ ten pulleys and ten counterweights.

U.S. Pat. No. 4,376,534 discloses a complex bowling pin cable adjustment apparatus that employs a complex arrangement of multiple springs and ratchets. Similarly, it would be desirable if such complexities could be avoided. In this respect, it would be desirable if a bowling apparatus were provided which does not employ a complex arrangement of multiple springs and ratchets.

Still other features would be desirable in a manually operated bowling apparatus. Bowling, because of its need for a relatively long bowling lane, is normally thought of as a sport confined to a particular location where a stationary bowling lane is located. However, since bowling is such a popular sport, it would be desirable is a bowling apparatus could be provided which were easily transportable and easily moved from one location to another. A transportable bowling apparatus could be used at outdoor locations at fairs, festivals, fund raisers, parties, and the like. A transportable bowling apparatus could also be used at indoor locations where bowling lanes are not already present.

Since complexity and excessive expense is to be avoided, it would be desirable if a bowling apparatus were provided which employs inexpensive, off-the-shelf components.

Thus, while the foregoing body of prior art indicates it to be well known to use bowling apparatus in which bowling pins are reset, the prior art described above does not teach or suggest a manually operated bowling apparatus which has the following combination of desirable features: (1) does not require a person to manually reset knocked down bowling pins one pin at a time; (2) resets ten bowling pins at a time without using complex automatic pin setting apparatus; (3) does not employ ten pulleys and ten counterweights; (4) does not employ a complex arrangement of multiple springs and ratchets; (5) is easily transportable and is easily moved from one location to another; and (6) employs inexpensive, off-the-shelf components. The foregoing desired characteristics are provided by the unique manually operated bowling apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a manually operated bowling apparatus for use with a bowling lane assembly and a bowling ball and includes a support assembly which includes leg members which straddle an end portion of the bowling lane assembly. The manually operated bowling apparatus also includes an overhead support member which is supported in an elevated position above the bowling lane assembly by the leg members. A tether guide plate is supported by the support assembly at a position between the overhead support member and the bowling lane assembly. The tether guide plate includes ten pin-tether guide apertures arrayed in a first triangular pin-set arrangement of one, two, three, and four apertures in four respective lines.

A pin guide assembly is supported by a first winch assembly which is supported by the overhead support member of the support assembly. The pin guide assembly includes a pin-guide plate suspended by a plurality of flexible support cables from the first winch assembly. The pin-guide plate includes ten pin-guide apertures arrayed in a second triangular pin-set arrangement of one, two, three, and four apertures in four respective lines. The pin-tether guide apertures and the pin-guide apertures are in registration with each other.

A set of ten bowling pin assemblies are connected to a second winch assembly supported by the overhead support member. Each of the bowling pin assemblies includes a bowling pin member and a pin tether connected between the bowling pin member and the second winch assembly. The pin tethers are threaded from the bowling pin members through the pin-guide apertures in the pin-guide plate and through the pin-tether guide apertures in the tether guide plate before connection the second winch assembly.

The first winch assembly is connected to the flexible support cables for controlling raising and lowering of the pin-guide plate. The second winch assembly is connected to the pin tethers for controlling raising the bowling pin members into the pin-guide apertures for aligning the bowling pin members in the second triangular pin-set arrangement. The second winch assembly is also used for lowering the bowling pin members back onto the bowling lane assembly. The first winch assembly and the second winch assembly are manually operated winch assemblies.

The tether guide plate includes support-cable-guide apertures for guiding movement of the flexible support cables through the tether guide plate. The support assembly includes a pair of transverse intermediate support bars for supporting the tether guide plate. The intermediate support bars are supported by the leg members of the support assembly.

The first winch assembly includes a first pulley assembly connected to the overhead support member. A first connector member is connected to the overhead support member. A first handle-crank assembly is connected to the first connector member, and a first drum assembly is connected to the first drum assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodhnents and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manually operated bowling apparatus which has all of the advantages of the prior art and none of the disadvantages.

It is another object of the present invention to provide a new and improved manually operated bowling apparatus which may be easily and efficiently manufactured and marketed.

It is a further object of the present invention to provide a new and improved manually operated bowling apparatus which is of durable and reliable construction.

An even further object of the present invention is to provide a new and improved manually operated bowling apparatus which is susceptible of a low cost of manufacture with regard to both materials and labor, and which accordingly is then susceptible of low prices of sale to the consuming public, thereby making such manually operated bowling apparatus available to the buying public.

Still yet a further object of the present invention is to provide a new and improved manually operated bowling apparatus which does not require a person to manually reset knocked down bowling pins one pin at a time.

Still another object of the present invention is to provide a new and improved manually operated bowling apparatus that resets ten bowling pins at a time without using complex automatic pin setting apparatus.

Yet another object of the present invention is to provide a new and improved manually operated bowling apparatus which does not employ ten pulleys and ten counterweights.

Even another object of the present invention is to provide a new and improved manually operated bowling apparatus that does not employ a complex arrangement of multiple springs and ratchets.

Still a further object of the present invention is to provide a new and improved manually operated bowling apparatus which is easily transportable and is easily moved from one location to another.

Yet another object of the present invention is to provide a new and improved manually operated bowling apparatus that employs inexpensive, off-the-shelf components.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved manually operated bowling apparatus embodying the principles and concepts of the present invention will be described.

Figure 1:
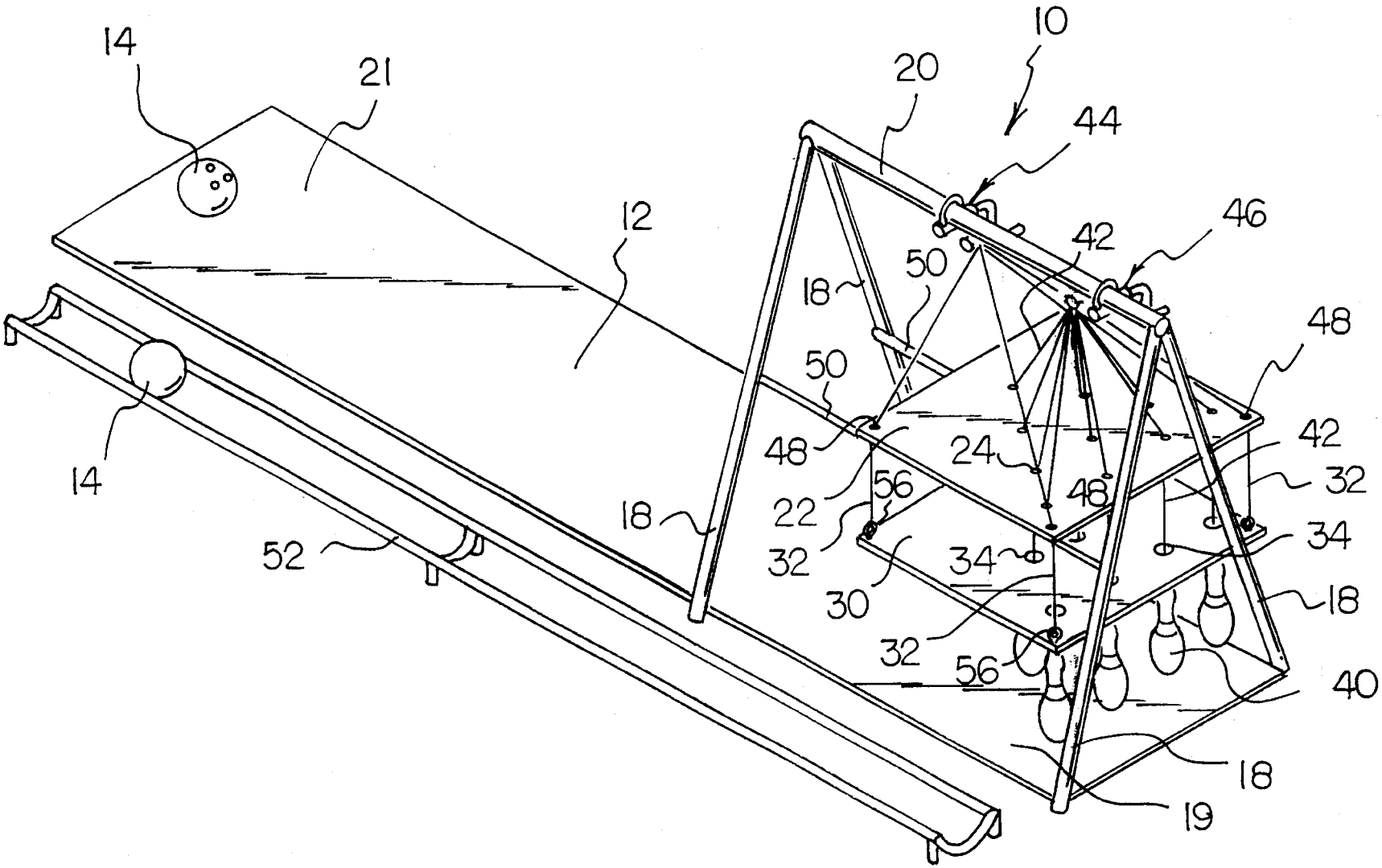
FIG. 1 is a perspective view showing a preferred embodiment of the manually operated bowling apparatus of the invention.
Figure 2:
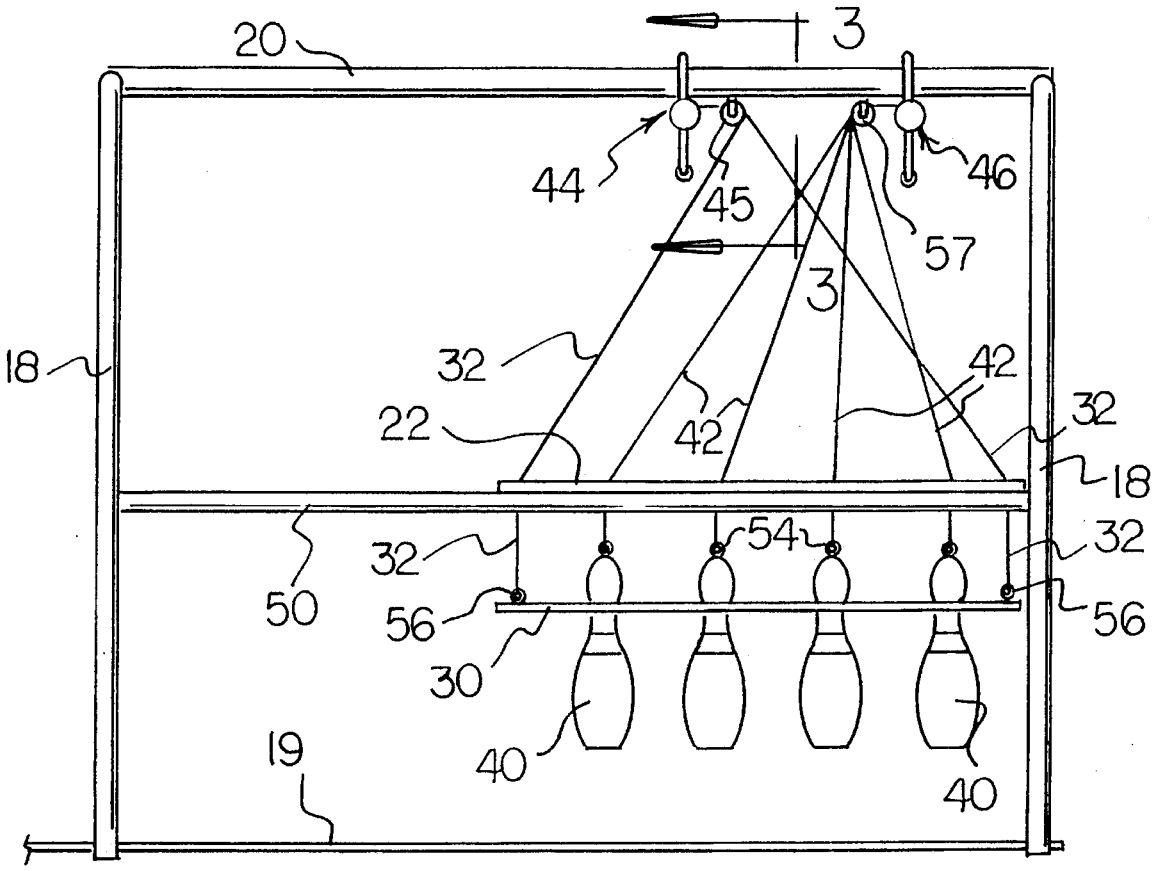
FIG. 2 is an enlarged side view of the pin setting portion of the embodiment of the invention shown in FIG. 1.
Figure 3:
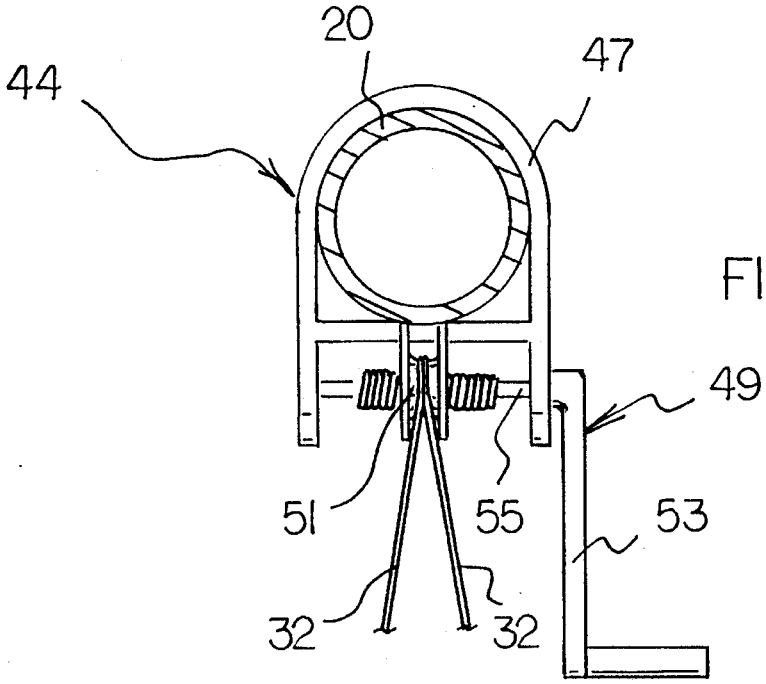
FIG. 3 is an enlarged cross-sectional view of the portion of the embodiment of the invention shown in FIG. 2 taken along line 3—3 thereof.
Figure 4:
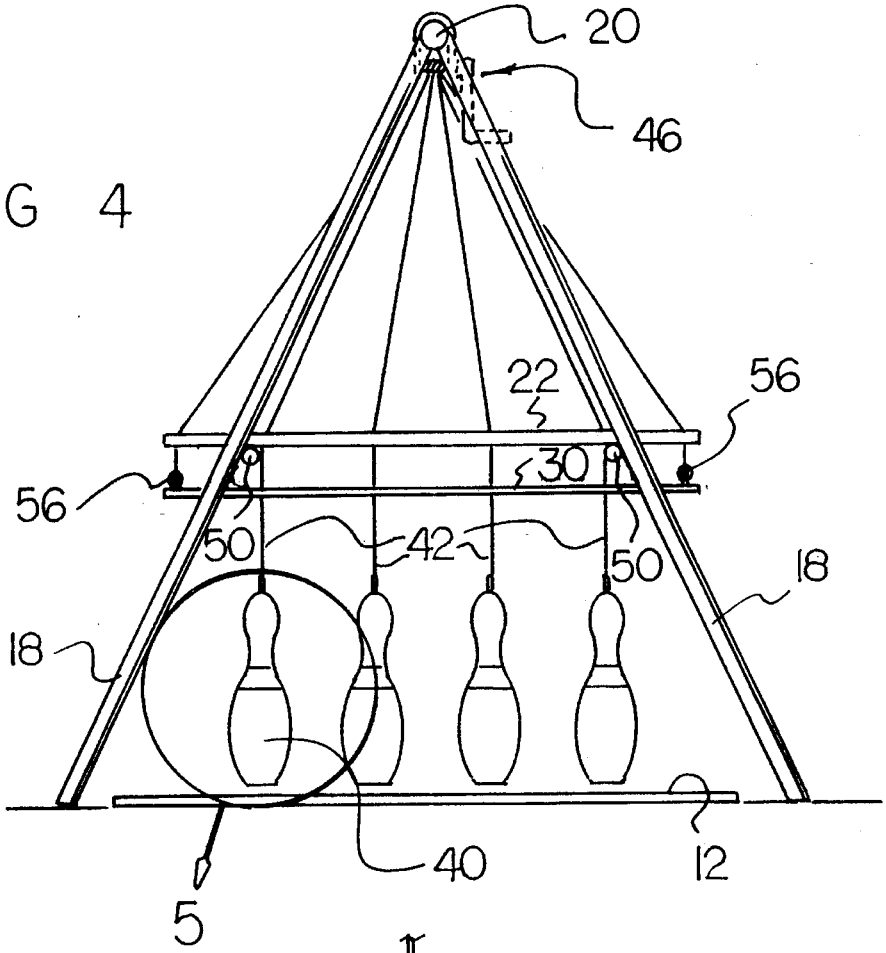
FIG. 4 is a front view of the embodiment of the invention shown in FIG. 1.
Figure 5:
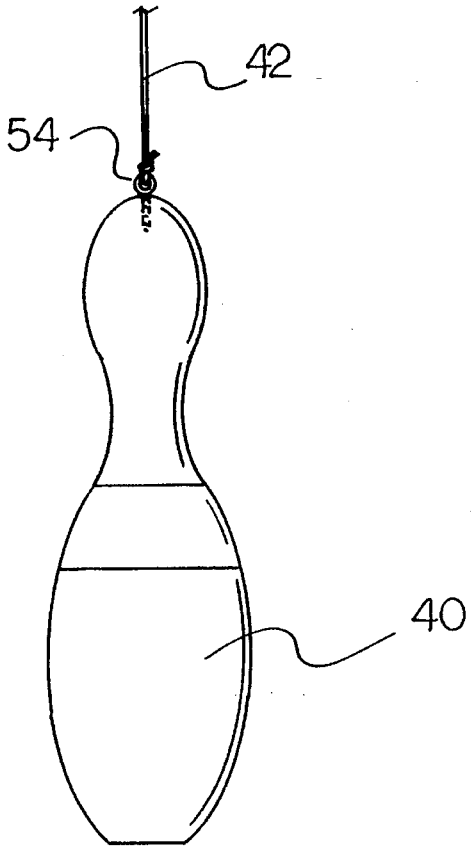
FIG. 5 is an enlarged front view of a tethered pin portion of the embodiment of the invention shown in circled portion 5 of FIG. 4.

Turning to FIGS. 1–5, there is shown an exemplary embodiment of the manually operated bowling apparatus of the invention generally designated by reference numeral 10. In its preferred form, manually operated bowling apparatus 10 is provided for use with a bowling lane assembly 12 and a bowling ball 14 and includes a support assembly which includes leg members 18 which straddle an end portion 19 of the bowling lane assembly 12. The manually operated bowling apparatus 10 also includes an overhead support member 20 which is supported in an elevated position above the bowling lane assembly 12 by the leg members 18. A tether guide plate 22 is supported by the support assembly at a position between the overhead support member 20 and the bowling lane assembly 12. The tether guide plate 22 includes ten pin-tether guide apertures 24 arrayed in a first triangular pin-set arrangement of one, two, three, and four apertures in four respective lines.

A pin guide assembly is supported by a first winch assembly 44 which is supported by the overhead support member 20 of the support assembly. The pin guide assembly includes a pin-guide plate 30 suspended by a plurality of flexible support cables 32 from the first winch assembly 44. The pin-guide plate 30 includes ten pin-guide apertures 34 arrayed in a second triangular pin-set arrangement of one, two, three, and four apertures in four respective lines. The pin-tether guide apertures 24 and the pin-guide apertures 34 are in registration with each other.

A set of ten bowling pin assemblies is connected to a second winch assembly 46 which is supported by the overhead support member 20. Each of the bowling pin assemblies includes a bowling pin member 40 and a pin tether 42 connected between the bowling pin member 40 and the second winch assembly 46. The pin tethers 42 are threaded from the bowling pin members 40 through the pin-guide apertures 34 in the pin-guide plate 30 and through the pin-tether guide apertures 24 in the tether guide plate 22 before connection to the second winch assembly 46.

The first winch assembly 44 is connected to the flexible support cables 32 for controlling raising and lowering of the pin-guide plate 30.

The second winch assembly 46 is connected to the overhead support member 20. The second winch assembly 46 is connected to the pin tethers 42 for controlling raising the bowling pin members 40 into the pin-guide apertures 34 for aligning the bowling pin members 40 in the second triangular pin-set arrangement. The second winch assembly 46 is used for lowering the bowling pin members 40 back onto the bowling lane assembly 12. The first winch assembly 44 and the second winch assembly 46 are manually operated winch assemblies.

The tether guide plate 22 includes support-cable-guide apertures 48 for guiding movement of the flexible support cables 32 through the tether guide plate 22. The support assembly includes a pair of transverse intermediate support bars 50 for supporting the tether guide plate 22. The intermediate support bars 50 are supported by the leg members 18 of the support assembly.

The first winch assembly 44 includes a first pulley assembly 45 connected to the overhead support member 20. A first connector member 47 is connected to the overhead support member 20. A first handle-crank assembly 49 is connected to the first connector member 47, and a first drum assembly 51 is connected the first drum assembly 49. In using the first winch assembly 44, the ends of the flexible support cables 32 are threaded through the first pulley assembly 45 onto the first drum assembly 51. The first drum assembly 49 has a handle unit 53 and a spindle unit 55 operated by the handle unit 53. In operating the first winch assembly 44, when the handle unit 53 is turned in one direction, the spindle unit 55 is rotated, and the flexible support cables 32 are wound up on the first drum assembly 51. When this occurs, the pin-guide plate 30 is elevated. On the other hand, when the handle unit 53 is turned in the opposite direction, the spindle unit 55 is rotated in the opposite direction, and the flexible support cables 32 are unwound from the first drum assembly 51. When this occurs, the pin-guide plate 30 is lowered.

The second winch assembly 46 is constructed in a substantially similar way and operates in a substantially similar way to the first winch assembly 44. However, with the second winch assembly 46, a second pulley assembly 57 is provided which receives the pin tethers 42, and the pin tethers 42 are wound onto or unwound from a second drum assembly of the second winch assembly 46. When the pin tethers 42 are wound onto the second winch assembly 46, the bowling pin members 40 are raised. When the pin tethers 42 are unwound from the second winch assembly 46, the bowling pin members 40 are lowered.

The manually operated bowling apparatus 10 of the invention can be used indoors or outdoors. Moreover, the manually operated bowling apparatus 10 of the invention can be used with an existing bowling lane assembly 12 and can be used with existing bowling balls 14. Alternatively, a set of bowling balls 14 and a portable, transportable bowling lane assembly 12 can be provided with the manually operated bowling apparatus 10 to form an easily transportable manually operated bowling apparatus 10. In this case, all of the components of the manually operated bowling apparatus 10 can be loaded onto a trailer and transported to any desired location.

In operating the embodiment of the invention shown in the drawing figures, the leg members 18 of the support assembly are placed to straddle the end portion 19 of the bowling lane assembly 12. The first winch assembly 44 is manually operated to raise the pin-guide plate 30 to the elevated position shown in FIG. 2. The second winch assembly 46 is manually operated to pull up on the pin tethers 42 to raise the bowling pin members 40. The top portions of the bowling pin members 40 are pulled into the pin-guide apertures 34 in the pin-guide plate 30. As a result, the bowling pin members 40 are arrayed in a triangular, ten pin-set arrangement. Then, both the first winch assembly 44 and the second winch assembly 46 are operated simultaneously to lower the bowling pin members 40 onto the bowling lane assembly 12 while in the triangular, ten pin-set arrangement. Once the bowling pin members 40 are resting on the bowling lane assembly 12, the first winch assembly 44 is operated to raise the pin-guide plate 30 off of the bowling pin members 40. In addition, the second winch assembly 46 is operated to give slack in the pin tethers 42 so that if one or more pins are hit by a bowling ball 14, the pins can fall over.

After the bowling pin members 40 are standing on the bowling lane assembly 12 in a triangular, ten pin-set arrangement, and after the pin-guide plate 30 has been raised, and after the pin tethers 42 have been provided slack. A person can roll a bowling ball 14 down the bowling lane assembly 12 at the bowling pin members 40. If less than ten bowling pin members 40 are knocked over by either the bowling ball 14 or by other bowling pin members 40 knocked over by the bowling ball 14, then the knocked over bowling pin members 40 are removed manually from the bowling lane assembly 12. The slack in the pin tethers 42 is sufficient to permit the bowling pin members 40 to be removed from the bowling lane assembly 12.

Either the first bowling ball 14 is returned to the person, or a second bowling ball 14 is employed, and the person bowls the bowling ball 14. After the knocked down pins are counted from the second bowling ball 14, all ten pins can be reset as described above.

A ball return ramp assembly 52 is provided along side the bowling lane assembly 12 to permit a bowling ball 14 to be returned to toward the front portion 21 of the bowling lane assembly 12 from the end portion 19 of the bowling lane assembly 12.

Although specific details of construction can assume a wide variety of dimensions and configurations, certain specific dimensions and configurations have been found to be suitable. For example, the overhead support member 20 can be approximately 6 feet above the bowling lane assembly 12.

Each bowling pin member 40 is drilled with a 7/64 drill bit to provide a centered pilot hole. A single 1 and 7/8 inch medium screw eye 54 is screwed into the pilot hole of each bowling pin member 40. Ten 6 feet lengths of nylon rope that is 3/16 inch diameter are cut to make first portions of the pin tethers 42. For each nylon rope portion for each bowling pin members 40, one end of each nylon rope portion is tied to the screw eye 54. The other end of each nylon rope portion is threaded through a pin-guide aperture 34 in the pin-guide plate 30 and through a pin-tether guide aperture 24 in the tether guide plate 22. Each free nylon rope end can be is connected to a pivotal bolt snap (not shown). A single trunk rope (not shown) can be used to receive the ends of the nylon rope portions to provide a single trunk rope operated by the second winch assembly 46.

The first winch assembly 44 and the second winch assembly 46 can be attached to the overhead support member 20 by a 2 inch U-bolt. The pin-guide plate 30 can be made from 1/4 inch thick peg board that is readily commercially available at hardware st and the like. The triangular pin-set arrangement can be marked on the pin-guide plate 30, and the pin-guide apertures 34 can be formed in the pin-guide plate 30. The pin-guide apertures 34 are approximately 3 inches in diameter.

The tether guide plate 22 can be made of a 4 feet by 4 feet plywood sheet that is 3/8 inch thick. The triangular pin-set arrangement can be drilled into the tether guide plate 22 using a drill with a 1/4 inch drill bit. The 1/4 drill bit can also be used to drill the support-cable-guide apertures 48 in the tether guide plate 22.

The flexible support cables 32 are connected to the pin-guide plate 30 by metal eye containing connectors 56. The tether guide plate 22 can be supported by the intermediate support bars 50 at approximately 28 1/2 inches above the bowling lane assembly 12.

A hole is drilled with an 11/64 inch drill bit through each of the corners of the tether guide plate 22 and the intermediate support bars 50. Then a screw is placed through the holes to secure the intermediate support bars 50 to the tether guide plate 22.

The leg members 18 can be made from 15/8 inch by 6 feet 6 inch long galvanized steel tubes which may be obtained at a hardware or fencing supply store. T-shaped connectors can be used to fit the tubing together at right angles.

The components of the manually operated bowling apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved manually operated bowling apparatus that is low in cost, relatively simple in design and operation, and which may advantageously be used without requiring a person to manually reset knocked down bowling pins one pin at a time. With the invention, a manually operated bowling apparatus is provided which resets ten bowling pins at a time without using complex automatic pin setting apparatus. With the invention, a manually operated bowling apparatus is provided which does not employ ten pulleys and ten counterweights. With the invention, a manually operated bowling apparatus is provided which does not employ a complex arrangement of multiple springs and ratchets. With the invention, a manually operated bowling apparatus is provided which is easily transportable and is easily moved from one location to another. With the invention, a manually operated bowling apparatus is provided which employs inexpensive, off-the-shelf components.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A manually operated bowling apparatus for use with a bowling lane assembly and a bowling ball, comprising:

a support assembly which includes leg members and which includes an overhead support member which is supported in an elevated position by said leg members, a tether guide plate supported by said support assembly at a position below said overhead support member, wherein said tether guide plate includes ten pin-tether guide apertures arrayed in a first triangular pin-set arrangement of one, two, three, and four apertures in four respective lines, a first winch assembly supported by said overhead support member of said support assembly, a pin guide assembly supported by said first winch assembly, wherein said pin guide assembly includes a pin-guide plate suspended by a plurality of flexible support cables from said first winch assembly, wherein said pin-guide plate includes ten pin-guide apertures arrayed in a second triangular pin-set arrangement of one, two, three, and four apertures in four respective lines, wherein said pin-tether guide apertures and said pin-guide apertures are in registration with each other, a second winch assembly supported by said overhead support member of said support assembly, and a set of ten bowling pin assemblies connected to said second winch assembly, wherein each of said bowling pin assemblies includes a bowling pin member and a pin tether connected between said bowling pin member and said second winch assembly, wherein said pin tethers are threaded from said bowling pin members through said pin-guide apertures in said pin-guide plate and through said pin-tether guide apertures in said tether guide plate before connection to said overhead support member of said support assembly, wherein said first winch assembly is connected to said flexible support cables for controlling raising and lowering of said pin-guide plate, and wherein said second winch assembly is connected to said pin tethers for controlling raising said bowling pin members into said pin-guide apertures for aligning said bowling pin members in said second triangular pin-set arrangement, and wherein said second winch assembly is for lowering said bowling pin members back onto the bowling lane assembly.

2. The apparatus of claim 1 wherein said first winch assembly and said second winch assembly are manually operated winch assemblies.

3. The apparatus of claim 1 wherein said tether guide plate includes support-cable-guide apertures for guiding movement of said flexible support cables through said tether guide plate.

4. The apparatus of claim 1 wherein said support assembly includes a pair of transverse intermediate support bars for supporting said tether guide plate.

5. The apparatus of claim 4 wherein said intermediate support bars are supported by said leg members of said support assembly.

6. The apparatus of claim 1 wherein said first winch assembly includes:

a first pulley assembly connected to said overhead support member, a first connector member connected to said overhead support member, a first handle-crank assembly connected to said first connector member, and a first drum assembly connected to said first drum assembly.

* * * * *